United States Patent [19]

Svenning

[11] Patent Number: 4,860,681

[45] Date of Patent: Aug. 29, 1989

[54] APPARATUS FOR CARRYING OUT OPERATIONS UNDER WATER

[75] Inventor: Bjornar Svenning, Trondheim, Norway

[73] Assignee: Den norske stats oljeselskap a.s., Norway

[21] Appl. No.: 149,228

[22] PCT Filed: May 22, 1987

[86] PCT No.: PCT/NO87/00039

§ 371 Date: Jan. 25, 1988

§ 102(e) Date: Jan. 25, 1988

[87] PCT Pub. No.: WO87/07232

PCT Pub. Date: Dec. 3, 1987

[30] Foreign Application Priority Data

May 23, 1986 [NO] Norway ..... 862053

[51] Int. Cl.[4] ..... B63G 8/00

[52] U.S. Cl. ..... 114/321; 114/313; 114/258; 114/268; 212/190

[58] Field of Search ..... 114/312, 313, 321, 256, 114/257, 268, 258; 414/137, 138, 139; 212/190

[56] References Cited

U.S. PATENT DOCUMENTS

| | | | |
|---|---|---|---|
| 2,541,893 | 2/1951 | Speer | 212/190 |
| 2,555,297 | 5/1951 | Smith et al. | 212/190 |
| 2,660,319 | 11/1953 | Dorland | 212/190 |
| 3,453,834 | 7/1969 | Jue | 414/137 |
| 3,677,212 | 7/1972 | Gregoire | 114/321 |
| 4,147,124 | 4/1979 | Brooks et al. . | |
| 4,357,764 | 11/1982 | Lemercier et al. | 114/313 |

FOREIGN PATENT DOCUMENTS

| | | |
|---|---|---|
| 2534970 | 2/1977 | Fed. Rep. of Germany . |
| 842544 | 6/1984 | Norway . |
| 850957 | 3/1985 | Norway . |
| 2172854 | 10/1986 | United Kingdom . |

*Primary Examiner*—Sherman D. Basinger
*Assistant Examiner*—Thomas J. Brahan
*Attorney, Agent, or Firm*—Lucas & Just

[57] ABSTRACT

An apparatus for carrying out operations under water having a twin hull autonomous submarine which in the space between two pressure hulls is provided with a cargo hold having an apparatus for receiving and carrying cargo units. The compartment between the pressure hulls is outwardly limited by inward hatches in the submarine's hydrodynamic outer hull (form hull). In the hold longitudinal running levels on both of the pressure hulls for at least one traverse crane and at least one cargo carrying wagon, as well as, preferably, a belly manipulator. The apparatus is used to carry out various operations in an underwater production system.

10 Claims, 27 Drawing Sheets

LANDING PROCEDURE:

VERTICAL THRUSTER

MAIN PROPULSION

MOVEMENT OF MASU

ROTATION OF OUTER ROLLS

CLAMPING FORCE (40 T IF POWER ONLY ON SIDE ROLLS)

APPARATUS FOR CARRYING OUT OPERATIONS UNDER WATER

TECHNICAL FIELD

This invention relates to an apparatus for carrying out of operations under water, comprising a twin hull autonomous submarine which, in the space between its two pressure hulls, is provided with a cargo hold with means for receiving and carrying cargo in the form of cargo units, where the space between the pressure hulls is externally confined by hatches in the hydrodynamic outer hull of the submarine.

BACKGROUND ART

The invention as far as the submarine is concerned has it's basis in the Norwegian patent application 850957 and represents a futher development of the concept described therein, especially with the intention to enable operations to be carried out optionally by any interaction with conventional techniques performed from a location above sea level (floating platform or vessel) thereby taking full advantage of developed, well-known and proven techniques and systems for subsea field development, operation and maintenance, making feasible full utilization of the advantages of a submarine concept (direct access-visually and diverless), while preserving the opportunity to take a step forward into a desirable completely non-surface, technological phase, a development which has promising perspectives in connection with offshore production of oil and gas, in particular at considerable depths.

Underwater production systems usually include the utilization of a so-called template or foundation frame, with room for several wellheads and associated equipment. Such a template can for instance comprise eight wellheads, advantageously arranged in two parallel rows, with four wellheads in each row. The underwater production system is advantageously constructed of units or modules. These modules are mounted and removed by means of guide posts and corresponding guide funnels, arranged in a standard system For each module, four guide posts are employed, one positioned in each corner of a square of standard dimensions. The modules can advantageously have guide funnels arranged in the same configuration, for guiding co-operation with the guide posts. During development of a field, i.e. installation of the underwater production system, modules are brought down and retrieved, from a location such as a rig, or a vessel on the surface. Guidelines are employed which run from the respective guide posts mounted in the foundation frame, up to the vessel. These guidelines can be fastened to the guide posts and reach up to a buoy when not in use, the guide lines being fished up by the surface vessel when it is necessary to install or replace one or several modules. The guide lines can also be releasably connected to the guide posts. For attaching of guidelines, divers or remotely controlled mini-submarines are used. The securing and connecting of the modules requires the work of divers, or the use of remotely controlled mini-submarines, or the use of complicated hydraulic remotely controlled tools.

During operation and maintenance the same technique is employed for the control and replacement of modules.

Installation and maintenance of an underwater production system, comprises not only the lowering and lifting up of modules, but also requires other kinds of operations, in particular coupling and uncoupling of pipelines are mentioned here. Such coupling and uncoupling can also be undertaken by means of work modules which are transported down from a rig or a vessel, utilizing guide posts and guide funnels.

The conventional technique indicated above is well known and proven and functionally quite satisfactorily. An important disadvantage however is its surface dependence and consequently its strong dependence on weather conditions at the surface. Continuously increasing depths makes it difficult or not very desirable to use divers. Remotely controlled mini-submarines have also been seen to have limited use.

In the initially mentioned Norwegian patent application 850957 (U.S. Pat. application Ser. No. 131,337 filed Dec. 9, 1987, which was a continuation of U.S. Pat. application Ser. No. 838,118 filed March 10, 1986 which claimed the priority of the Norwegiam patent application 850957) there is therefore suggested an apparatus for the execution of operations under water, comprising a twin hull submarine which can be combined with a number of defined cargo modules, where the twin hull submarine is provided with a cargo holder between it's two hulls, for carrying of cargo modules in the compartment between the hulls. With this kind of apparatus surface dependence can be avoided, i.e. it will be possible to install, run and maintain underwater production systems independent of surface weather conditions such as high seas, strong wind, drifting ice etc. The submarine is autonomous, that is, it is self reliant and manned and travels out from a suitable base on the coast, where loading, unloading, maintenance and bunkering take place. This means that work can take place in a system which to the greatest possible extent remains operational under water the whole time (travel out—work—travel to base). Independence of surface weather conditions then relates not only to the execution of work, but also during travelling to and from the place of work.

As mentioned, the conventional technique, with the use of guide lines, guide poles and guide funnels, is well proven and recognised. There is therefore a need for continuing use of this recognised technical concept, at the same time having the possibility to abolish surface dependence. In the said Norwegian patent applicatin 850957 a surface-independent system is outlined, without describing in detail how the apparatus can be utilized in combination with already known surface-dependent technique.

In addition to the guide line technique mentioned above, lowering and lifting-up of modules from a surface vessel without the use of guide lines is also known, whereby drive units (propel units) either mounted onto, or attached to the modules, are employed, enabling the module to be steered into position above the intended location, where the guide posts/funnel arrangements are still preferably used. The steering in and mounting naturally take place by means of divers, underwater cameras, mini-submarines, various types of navigation equipment etc.

Underwater production systems of the kind described above, will usually be surrounded by a protective structure. This is suitably constructed as a powerful frame welded together of pipe elements and placed around the production system. In some wates, for instance in the North Sea, it is necessary for such a protective structure to be overtrawlable, i.e. it should be designed so that fishing trawls will not become caught up in it, in the case of over-trawling. The present invention demands the use of such a protective structure, overtrawlable or not.

DISCLOSURE OF INVENTION

According to the invention, an apparatus is suggested, as mentioned initially, which is characterized in that the compartment between the two pressure hulls is confined above and below by top hatches respectively bottom hatches, that longitudinal rails are arranged in the compartment, at several levels on the two pressure hulls for (a) at least one traverse crane and (b) at least one cargo carrying wagon, as well as preferably (c) a belly manipulator, where the traverse crane includes means for raising the crossarm relative to the crane rails, and in that the submarine has landing/moving equipment for landing and moving of the submarine on a protective structure around an underwater production system.

Since the compartment is confined above and below by hatches, it is possible to achieve a favourable hydrodynamic outer hull or form hull for the submarine. This is of significance during the submarine's voyage. The provision of a traverse crane and a cargo wagon in the compartment enables the submarine to carry one or several modules, mounted on the cargo wagon/wagons. By means of the traverse crane, the modules can be handled, not only the module placed on the cargo wagon, but also the one already present in the underwater production system and which is to be replaced.

Therefore, since the submarine is provided with landing/moving equipment for landing and moving on the protective structure, it becomes possible to land and place the submarine in the appropriate position for mounting or replacing of a module in the underwater production system.

It is essential that the traverse crane includes means for raising the cross arm relative to the crane rails. The height of the cargo hold will naturally be limited by the submarine's vertical dimension. The traverse crane will be situated inside the cargo hold when the hatches are closed. In order to make full use of the hold's height for the cargo units (modules), it being possible at the same time to handle the cargo units by means of the traverse crane, it is necessary for the traverse crane to be able to take a position above the cargo. This is made possible since the traverse crane can be raised and lowered in relation to its rails. In the stowing position, the traverse crane will be situated at a level of height beneath the top hatches. In its normal position, the traverse crane can be raised in relation to the rails, so that when in use, the traverse crane will be in a position above the upper hatch level. In other words, the traverse crane can be lifted into a position which enables it to pass over the cargo units which are stored in the cargo hold.

A mentioned, the submarine will be mounted above and on to the protective structure. The cargo hold must therefore be accessible in the downward direction. The hold is therefore confined at the lower end by bottom hatches. When the submarine is mounted on the protective structure and the top hatches and bottom hatches are open, the compartment between the submarine's pressure hulls will be completely open, both upwards and downwards.

The traverse crane's means for raising the cross arm, include preferably shear legs between the cross arm and respective wheel boxes which run on the crane rails. Such a shear leg construction is a well-known construction which is economical and reliable in service.

The traverse crane is preferably constructed with a trolley moveable along the cross arm, which trolley carries a vertical, raisable and lowerable, telescopic lifting yoke. Such a construction makes practicable a positive i.e. controlled carrying of the cargo.

Suitably the cargo wagon is designed as a frame with wheel boxes along two opposite sides and with guide pins adapted to guide posts/guide funnels used in the underwater production system. This enables the mounting of cargo units or modules on to the cargo wagon whilst making use of the guide funnels which are already present on the module. In most cases the advantage will moreover be gained, that the module, on being mounted on to the cargo wagon, will be correctly situated in relation to it's position in the underwater production system, and also possibly be situated relative to its final position in the underwater production system with a defined angle (90°).

Top and bottom hatches are preferably designed as horizontally sliding hatches. This is advantageous especially for the bottom hatch, because the opening of the bottom hatches can be postponed until the submarine is mounted on the protective structure.

The bottom hatch is preferably divided cross-wise and is opened by sliding in the submarine's longitudinal direction.

The top hatch can preferably be divided along a longitudinal centre line and is opened by sliding across the centre line.

Such a cross-sliding will be the most advantageous for the top hatch, because otherwise conflict with the submarine's sail (tower) could occur. Suitably the landing/moving equipment includes vertical, telescopic, resilient wheel boxes, supported by the submarine's pressure hull and intended for landing on and drive co-operation with rails on the top of said protective structure. Such a construction of the landing/moving equipment facilitates a desirable soft landing and a moving of the submarine to the proper place, whilst the submarine is independent in relation to the protective structure and can at any time raise itself up from this and remove itself. This is a substantial safety factor.

For steering during both landing (docking) and departure it can be advantageous to use mechanical guiding means, the advantage being that at each wheel box a vertical extractable and retractable guide element is provided, intended for co-operation with a corresponding guide element on the protective structure.

Another suitable design of the landing/moving equipment is characterized in that it includes vertical, telescopic, resilient sets of rollers, comprising horizontal and vertical rollers, intended for landing on and driving co-operation with respective upper frame side elements in the protective structure consisting of pipe elements welded together.

Such a construction does then not demand and special rail arrangements on the protective structure. Instead, use is made of the powerful longitudinal upper frame side elements, usually formed by pipe elements.

BRIEF DESCRIPTION OF DRAWINGS

Further featurers of the invention and its advantages will be shown in more detail in the following description of preferred embodiments, with reference to the drawings where, FIG. 6 shows a perspective drawing of the landing-drive unit in FIG. 5, without the submarine and protective structure drawn in.

MODES FOR CARRYING OUT THE INVENTION

Figure 1:
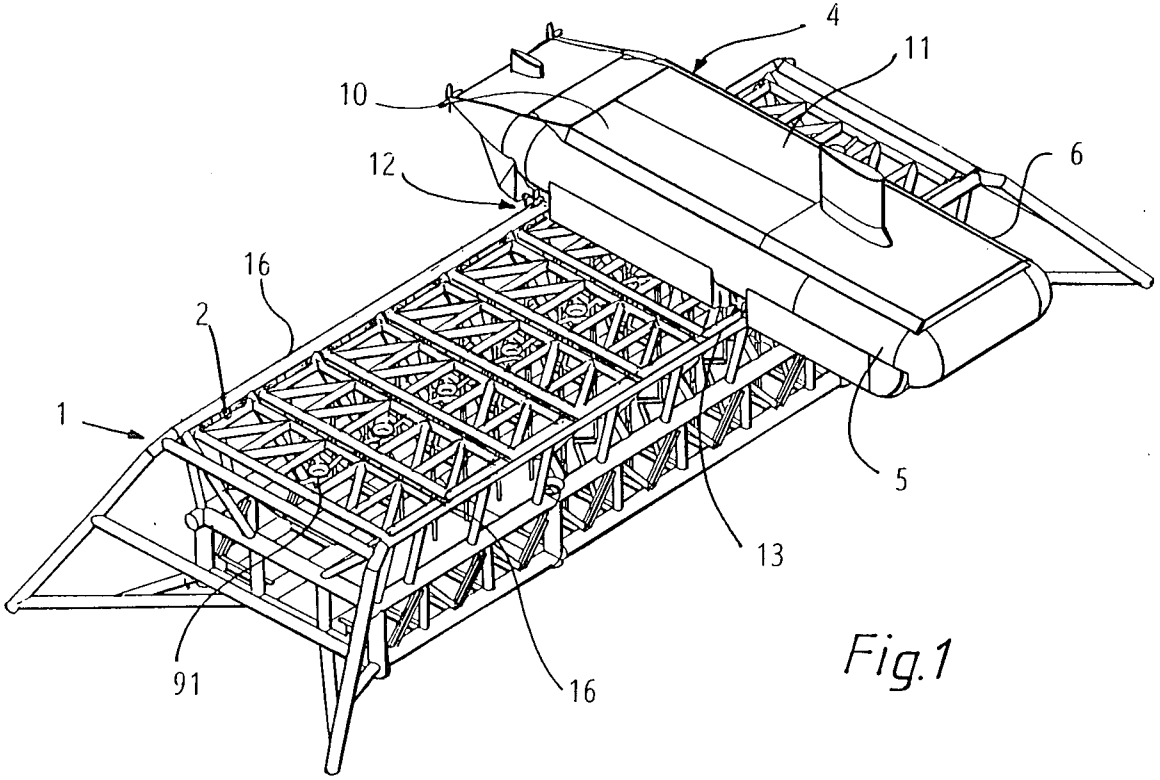
FIG. 1 shows an underwater production system with associated protective structure and with a submarine docked on to the protective structure.
Figure 11:
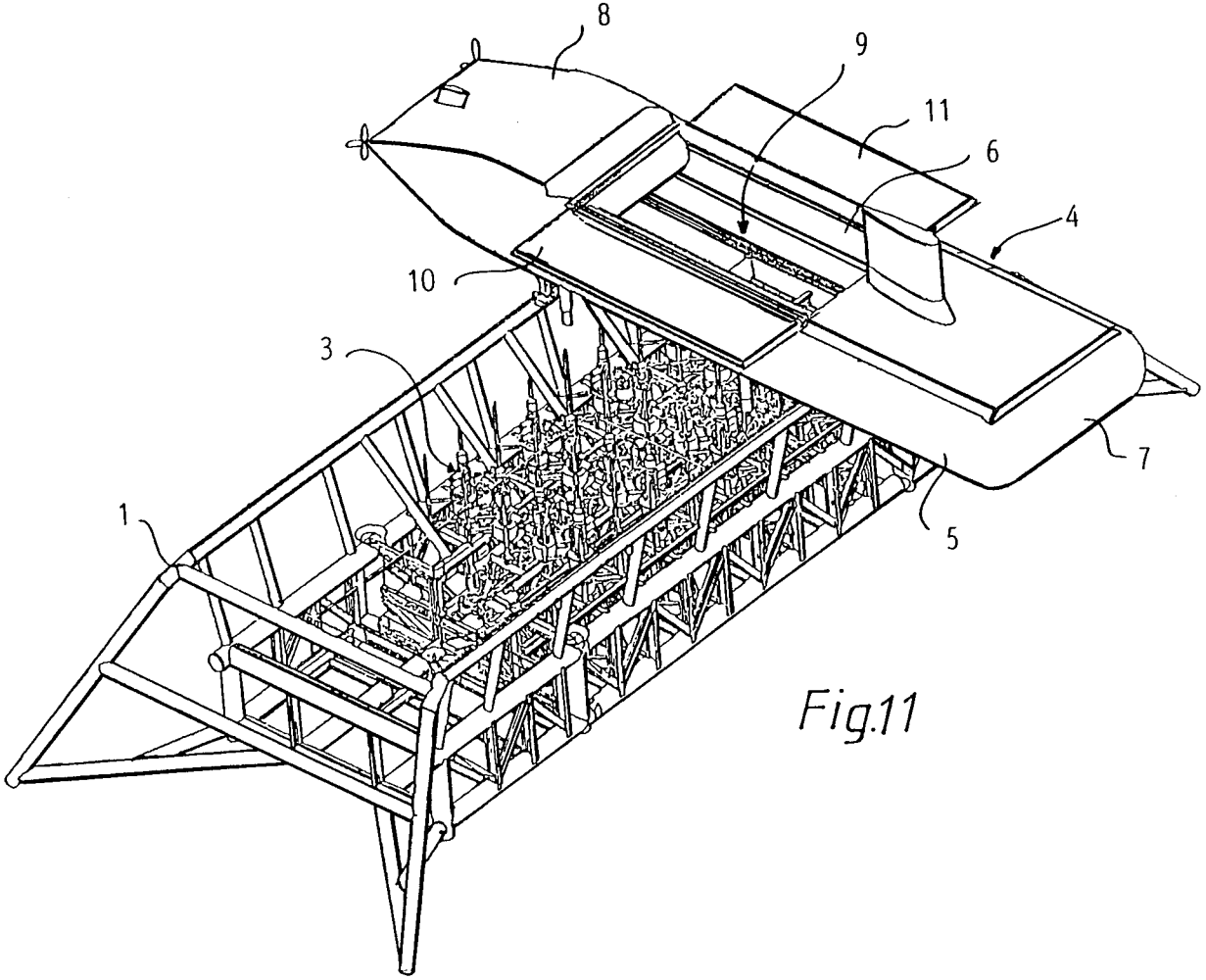
FIG. 11 shows the underwater production system with protective structure and docked submarine, as in FIG. 1, but with the submarine's hatches open and with the protective roof on the protective structure removed.

FIG. 1 shows an underwater production system with a protective structure 1. This protective structure extends around an underwater production system which is merely indicated in FIG. 1 but which can be seen more clearly in FIG. 11, where protective roof 2, which is a part of the protective structure, is removed. In FIG. 11 the underwater production system is indicated by the arrow 3. Both the protective structure and the underwater production system are known technology. The underwater production system includes several modules which constitute parts of the processing equipment. Such modules are by way of example, Christmas tree, control modules, transition modules, manifold-valve modules etc.

The protective structure is constructed in the known manner as a strong tubular truss-work structure. The shown protective structure 1 is over-trawlable.

The landed or docked submarine is indicated by 4. It is constructed of two pressure hulls 5 and 6. These are mutually parallel and joined together by means of tranverse hulls 7, 8. Between the pressure hulls 5, 6 a hold 9 is formed. In FIG. 1 this is closed above with top hatches 10, 11. In FIG. 11 the top hatches are pushed aside so that the hold 9 is open upwards. In FIG. 11 the not shown bottom hatches are also opened, so that the hold 9 is in fact completely open both upwards and downwards.

I FIG. 1 landing/moving units 12, 13 can be glimpsed, by means of which the submarine can move itself on the protective structure's 1 top. These details are not drawn into FIG. 11 so as not to complicate the drawing unnecessarily.

Figure 3:
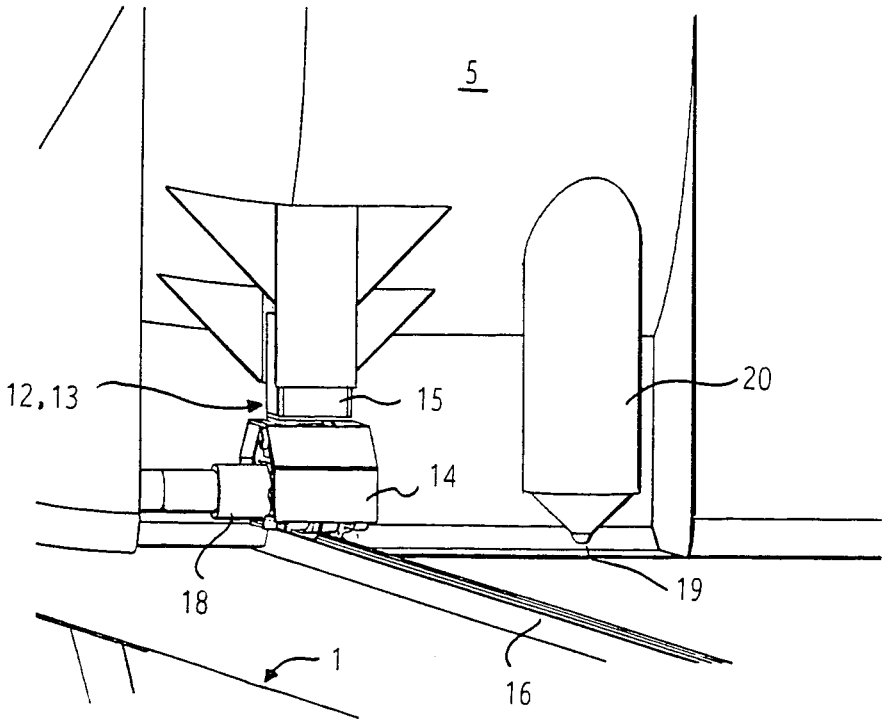
FIG. 3 shows a section of one side of the submarine, with a landing-drive unit.
Figure 4:
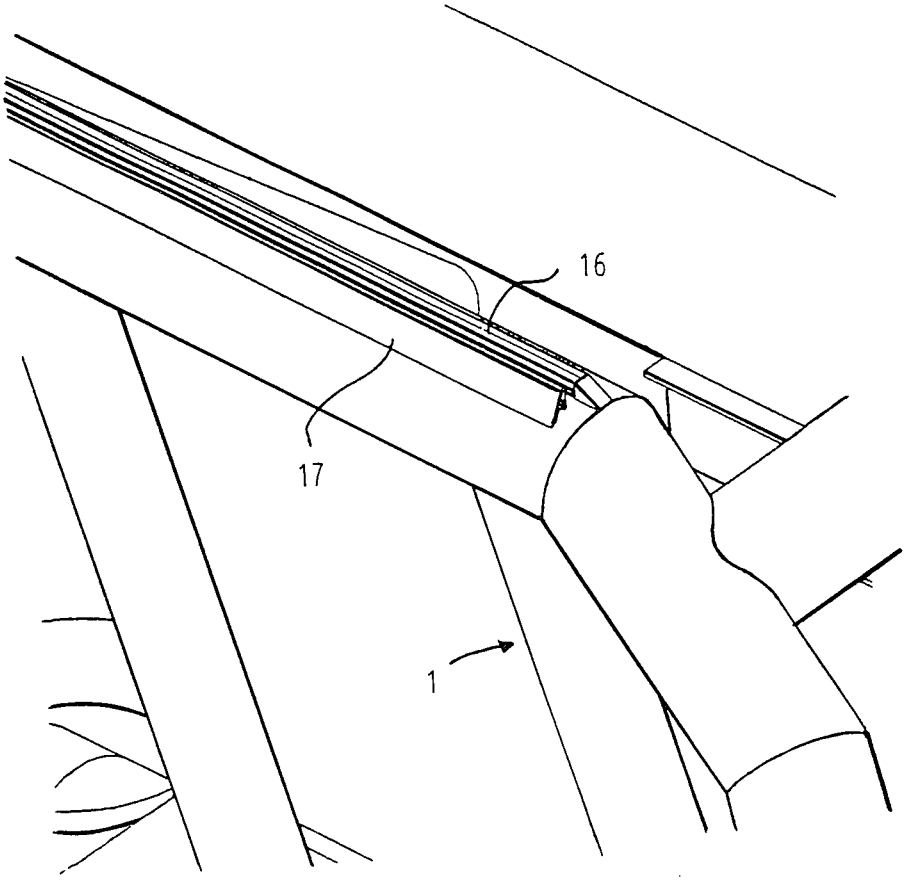
FIG. 4 shows a section of the protective structure, with drive rails for the submarine.

A landing/moving unit 12 or 13 is shown in larger scale in FIG. 3. The unit comprises a wheel box 14 which is supported by a vertical, telescopic resilient supportive column 15. The wheel box 14 has wheels which are shown resting on a rail 16 placed on the protective structure 1. This rail is shown in more detail in FIG. 4, where it is shown how a protective structure 17 is placed on the outer side of the rail. A drive-motor for the set of wheels in the wheel-box 14 is indicated with 18 in FIG. 3.

Figure 12:
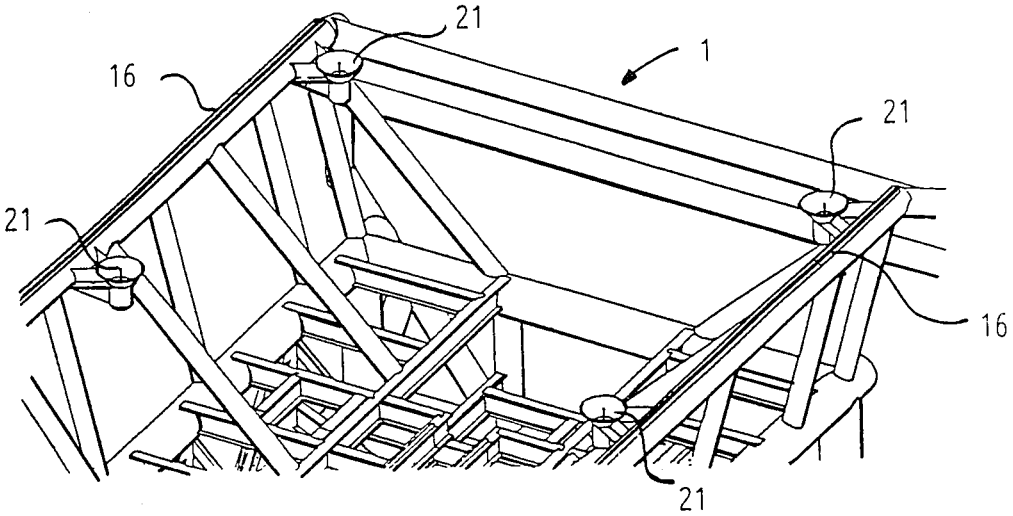
FIG. 12 shows a section of the protective structure with landing area for the apparatus.

In FIG. 3 a vertical raisable and lowerable guide element 19 is shown. In FIG. 3 this is shown completely withdrawn into a cylinder 20 which is attached to the submarine's pressure hull 5. The guide element 19 is in actual fact an extendable guide post which is intended for engagement with guide funnels 21 which are placed on the protective structure, in a area which is intended for docking of the submarine. When the submarine goes in for docking it is manoeuvred into position above the docking place shown in FIG. 12 (at the short end of the protective structure 1). The guide posts 19 are pushed out and brought into engagement with the guide funnels 21. The submarine can then be ballasted and made to submerge. The co-operation between the guide posts 19 and the guide funnels 21 leads to the wheel boxes 14 being placed correctly with their boggies on the rails 16. In the case of normal departure the submarine is brought into position above the docking area, and the guide posts 19 are pushed out once again to co-operate with the guide funnels. The submarine can then be relieved of it's ballast and it will then lift itself up from the protective structure, guided by the guide posts 19 and guide funnels 21.

Figure 5:
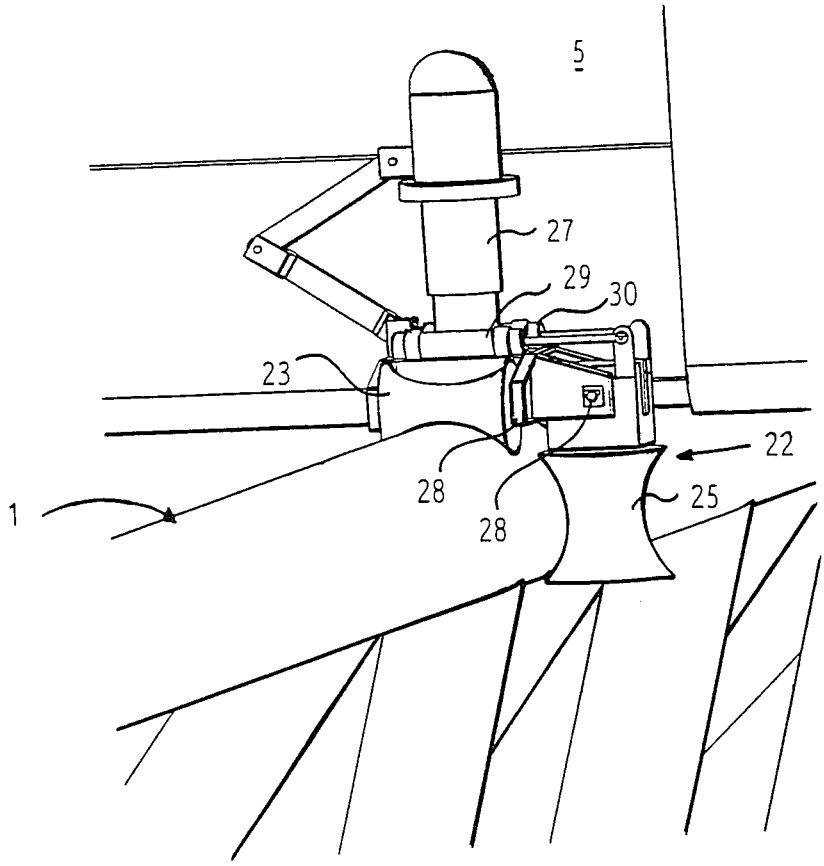
FIG. 5 shows a section of the side of the submarine, with another landing-drive unit, intended for direct cooperation with the protective structure.
Figure 6:
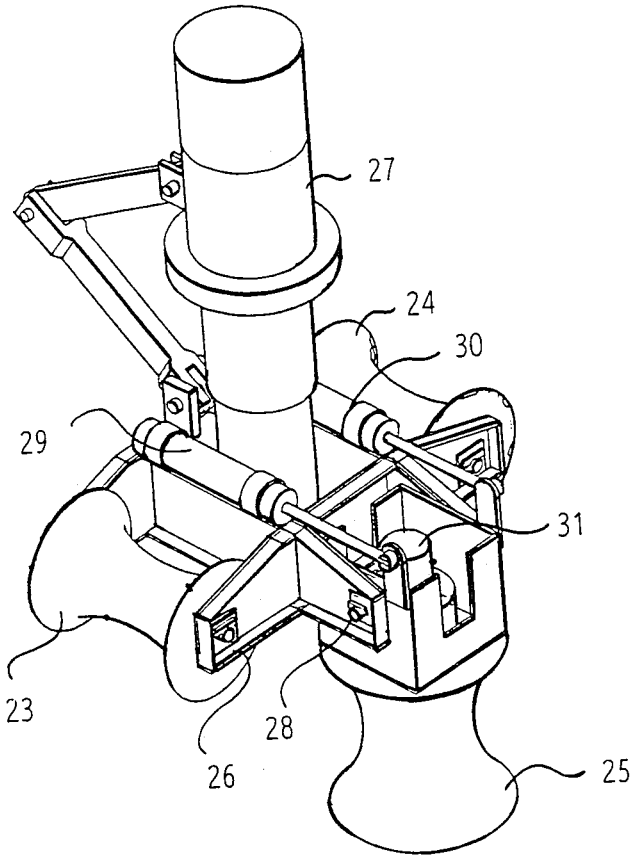
Figure 7:
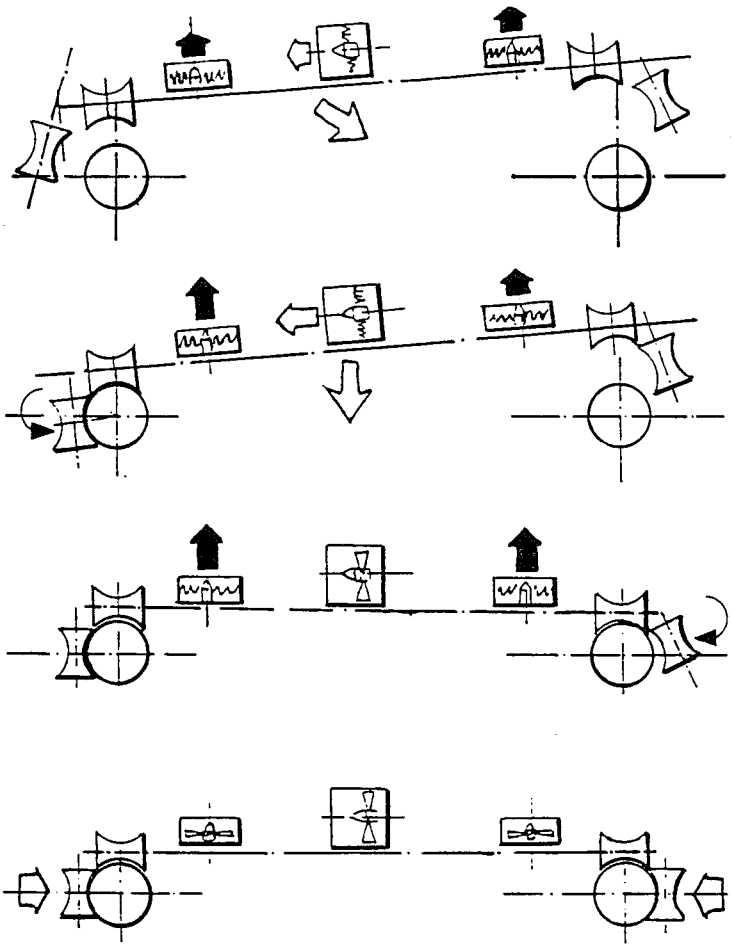
FIG. 7 shows in the FIGS. 7A, B, C and D, various phases during landing with the use of the equipment in FIG. 5 and 6.

Alternative docking gear is shown in FIG. 5, 6 and 7. This docking gear is intended for direct co-operation with the upper longitudinally extending, tubular elements of the protective structure. The docking/moving elements are situated at the same place on the submarine as the docking/moving elements 12, 13 (see FIG. 1), but instead of a telescopic resilient wheel box there is a respective telescopic resilient set of rollers 22. Each such set of rollers includes two horizontal rollers 23, 24, and one vertical roller 25. These rollers 23-25 are mounted in a frame 26 which is supported by a telescopic, resilient supportive column 27. The assembly of this can for example correspond to the embodiment known from aircraft landing gear.

The vertical roller 25 is pivotally arranged 28 in the frame 26, and can be swung by means of two hydraulic cylinders 29, 30. The roller 25 is moreover operable, by means of a drive motor 31.

When the submarine docks on to the protective structure 1 the rollers 25 will be swung out, as is shown in FIG. 7A. By means of the submarine's vertical and main thrusters the submarine is brought into dock with one bogie, for instance the rear bogie, as is shown in FIG. 7B. The roller 25 is swung into its verical position. The submarine is trimmed and brought in to dock with the fore bogie, as is shown in FIG. 7c. The rollers 25 in the fore bogie are then swung into a vertical position, as is indicated by the arrow in FIG. 7c, see also FIG. 7D. By means of the hydraulic cylinders 29, 30 a certain pressing force is exerted against the protective structure by means of the operable rollers 25, so that the submarine can be moved by operating the rollers 25 by means of their respective drive motors 31. The submarine can naturally be ballasted as necessary. At departure the opposite procedure is used.

Figure 2:
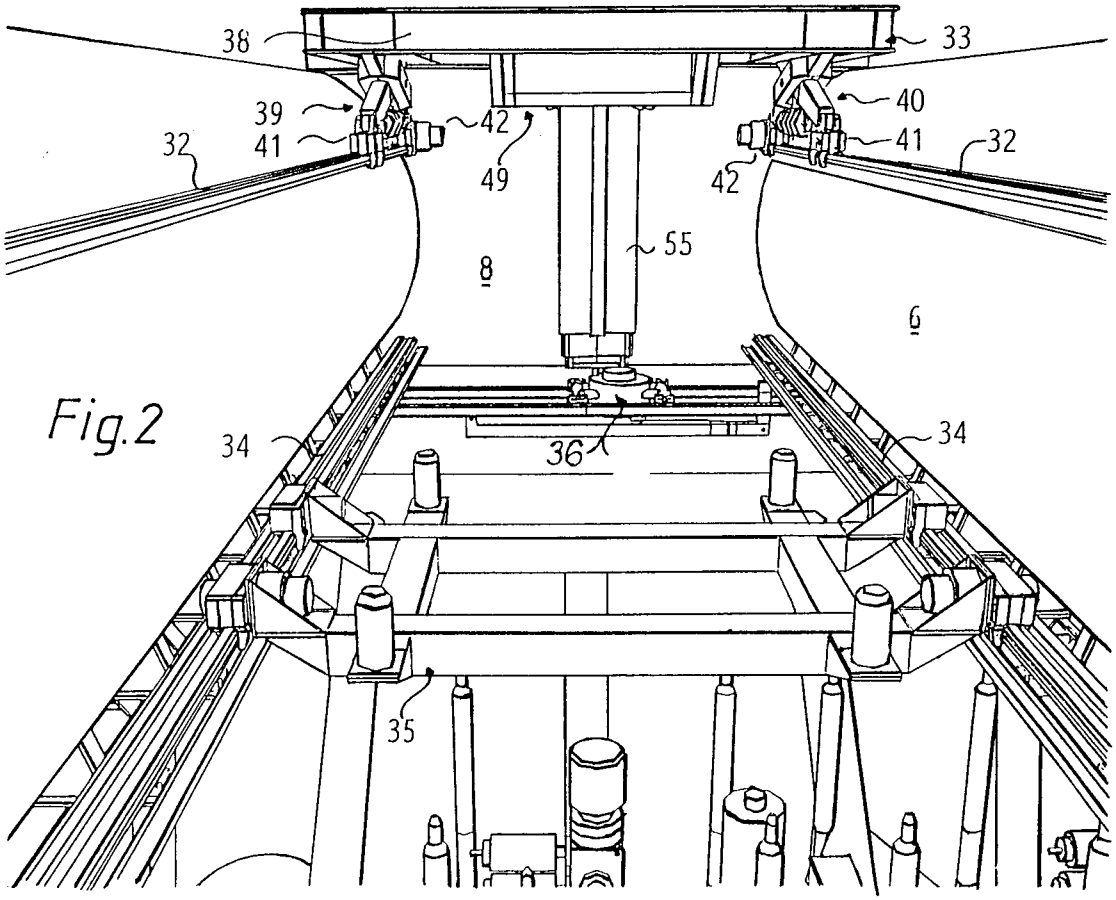
FIG. 2 shows a perspective drawing of the submarine's cargo hold, with cargo carrying wagon, traverse crane and belly manipulator.

FIG. 2 shows a perspective sketch of the cargo hold, in the way an operator on board in the submarine would be able to observe it through a suitable observation window. The two pressure hulls are indicated here by 5 and 6, whereas the rear intermediary hull is indicated by 8, the same way as in FIG. 11.

On the two pressure hulls 5 and 6 an upper set of rails 32 is mounted, intended for a traverse crane 33. Further down in the cargo hold a set of rails 34 is arranged for a cargo wagon 35. Below this set of rails 34, a lower set of rails, hidden in FIG. 2, is arranged for a belly manipulator 36. The belly manipulator and its set of rails are shown in more detail in FIG. 10, where the set of rails is shown as it is before it is welded on to the respective pressure hulls. The belly manipulator 36 is constructed so low that it can move under the cargo wagon 35 and thus move throughout the entire length of the cargo room on it's set of rails 37 (see FIG. 10).

The cargo wagon 35 is moveable on it's rails 34 along the entire length of the cargo hold. In FIG. 2 only one cargo wagon is shown. Naturally, several may be provided, coupled together if desired.

The traverse crane 33 is also movable on it's rails 32 throughout the entire length of the hold. The crane traverse can be raised or lowered in relation to the traverse crane's set of rails 32, due to the cross arm 38 being supported by shearlegs 39, 40 with associated wheel boxes 41, 42. The traverse crane and it's ability to be raised and lowered in relation to the crane rails 32 is important in the present concept. The structure of the traverse crane will be explained in more detail in the following, with reference to FIG. 2, 8, 13 and 14.

The cross arm 38 is assembled as a frame structure, welded together of H-shaped beams 43, 44, 45, 46. Inside the frame, two traverse H-beams 47, 48 are mounted, forming a frame compartment where a trolley 49 is placed. This trolley is also constructed as a welded frame structure, where two side elements are extended so that they engage with the longitudinal H-beams 43, 45 and rest on the inwardly facing flanges of these H-beams. The trolley 49 is moveable in the traverse frame 38 confined by the frame beams 47, 48. The movement is carried out by means of two hydraulic cylinders 50, 51 which are mounted on to the trolley 49, in that their respective piston rods 52, 53 are passes through openings in the trolley beam and secured to the inner frame beam 47. Such a securing shackle 54 is seen in FIG. 8.

In the centre of the trolley 49, a telescopic lifting yoke 55 is mounted. The lifting yoke 55 is steered in the trolley by means of edge steering rollers 56,57 and can be raised or lowered in the trolley by a drive motor, not shown in any more detail, which engages with a toothed bar 58 on the lifting yoke 55.

The lifting yoke 55 is, as mentioned, telescopic and in this case has two extendable telescope elements 59, 60. In the inner telescope element 60, a pivoted engagement device 61 is arranged.

Figure 8:
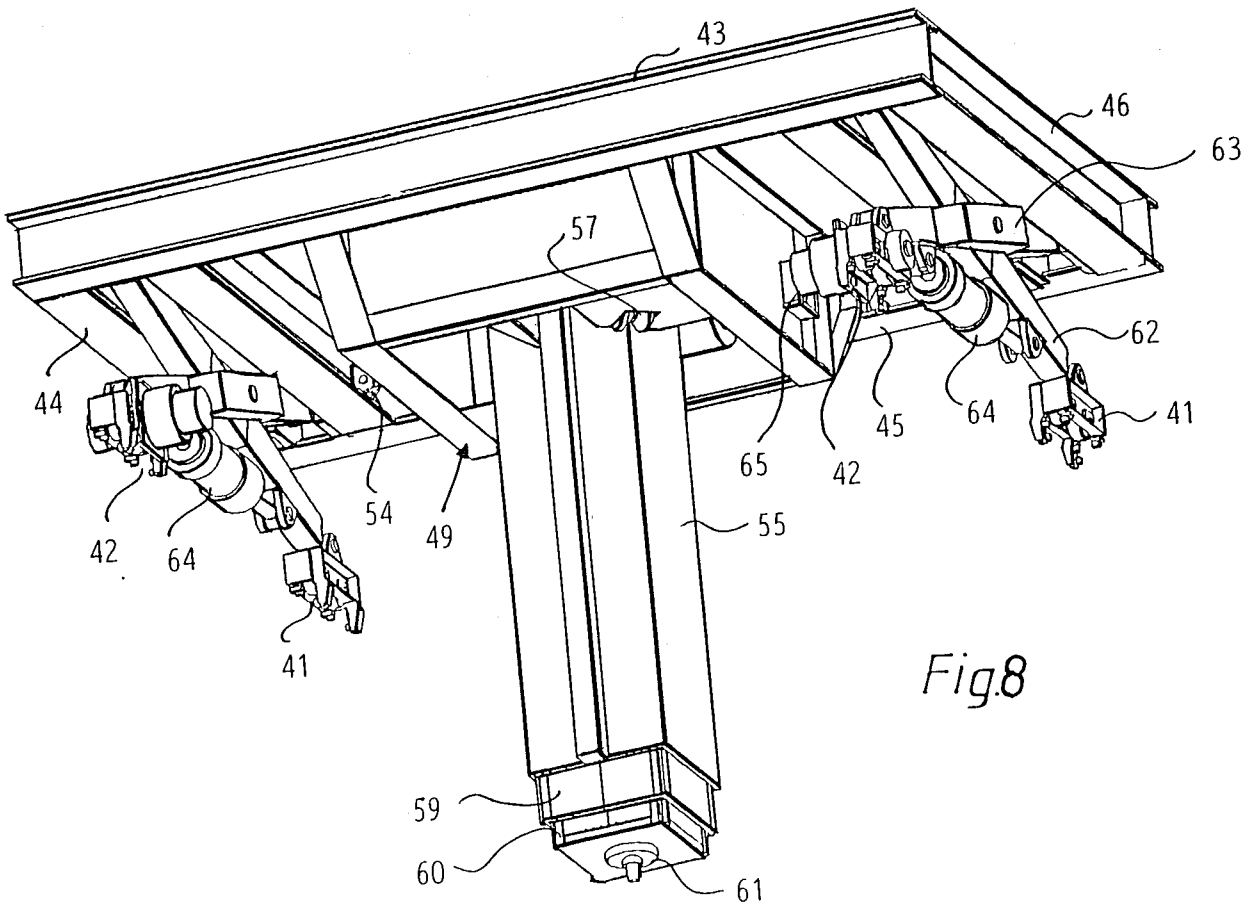
FIG. 8 shows a traverse crane viewed from the hold.
Figure 13:
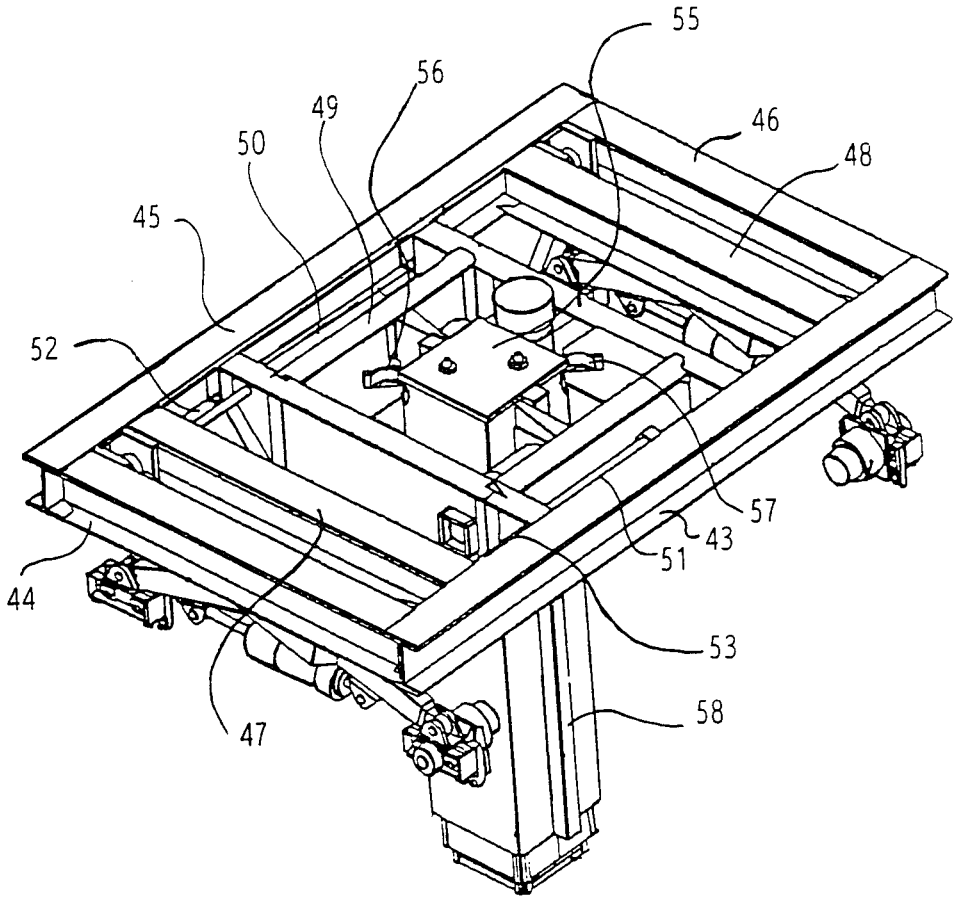
FIG. 13 shows the traverse crane seen from above.

The lifting yoke 55 can be moved vertically in the trolley 49, between the lower position shown in FIG. 2, 8 and 13 and an upper position where the engagement device 61 is situated close underneath the trolley 49.

The cross-arm 38 supports two shear legs 39, 40. Each such shear leg comprises two crossed-over legs 62, 63. Between these a hydraulic fluid power cylinder 64 is placed. The assembly of the shear legs is conventional and well known. The legs 62, 63 are at their upper ends pivotally supported in the cross-arm 38. At their lower ends, the legs 62, 63 support respective wheel boxes 41, 42. The wheel box 42 has a driving motor 65 for the wheel box's set of wheels.

Figure 14:
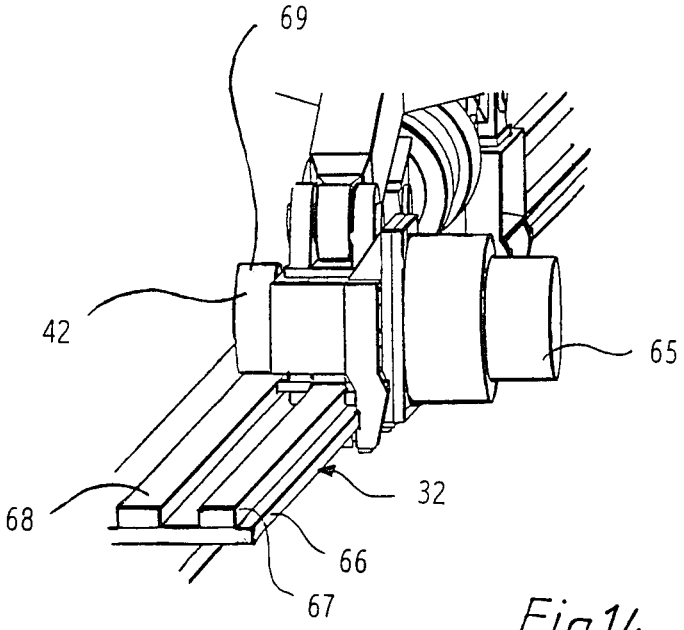
FIG. 14 shows a perspective section with a wheel box which is an integral part of the traverse crane.

In FIG. 14 the co-operation betweent a drivable wheel box 42 and a traverse crane rail 32 is shown in more detail. The crane rail 32 is made up of a bar plate 66 with a rail rib 67 and pitch rack 68 arranged on top of it. The wheel set in the wheel box 42 includes wheels which rest against the under-side of the bar plate 66 and against the flank of the rail rib 67. A cog wheel 69 driven by the motor 65 engages with the rack 68. The wheel set in the wheel box also includes wheels which rest against the flank on the rail rib 67 facing the rack.

By means of the shear legs, the traverse crane can be raised and lowered in relation to the crane rails 42. This means that traverse cranes can be stored in the submarine's cargo hold, beneath the top hatches, but the traverse crane can be raised, into a position where the traverse crane is able to move above units of cargo or modules which are placed on the cargo wagon 35.

Figure 9:
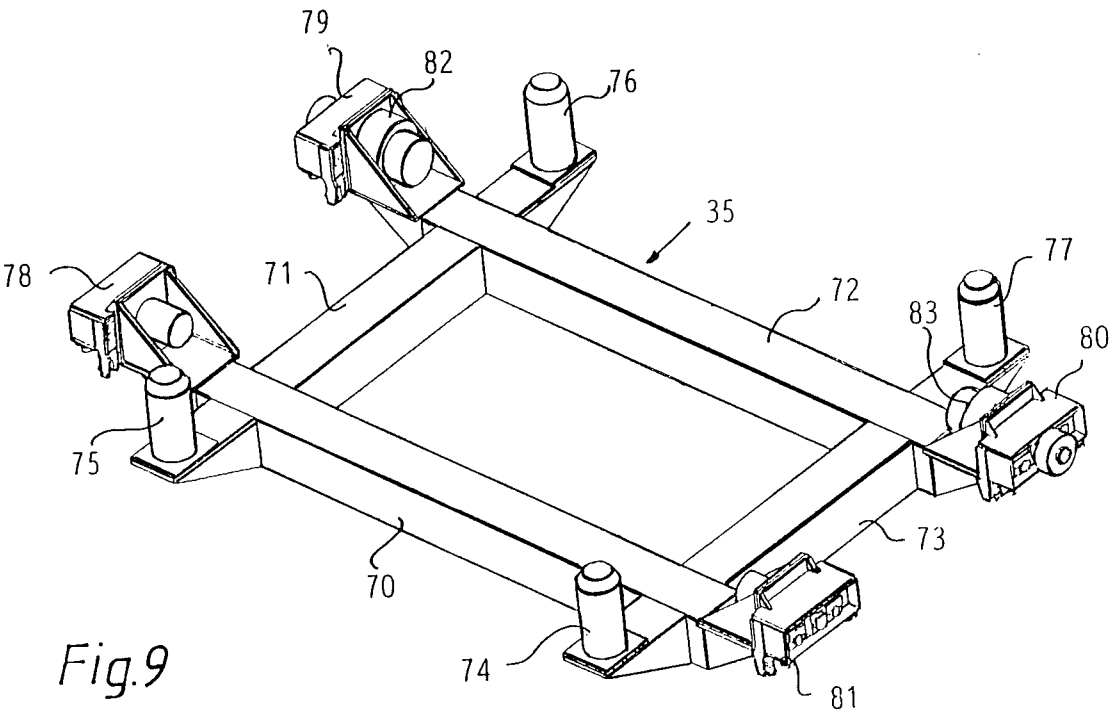
FIG. 9 shows a cargo wagon viewed from above.

Such a cargo wagon 35 is shown in FIG. 2 and is shown by itself in FIG. 9. It is assembled in a relatively simple way, in the form of a frame of beam elements 70, 71, 72 and 73 which are welded together. On the two longitudinal beam elements 71, 73, guide pins 74, 75, 76 and 77 are provided. These are placed with the same standard distance as the guide posts commonly used in the underwater production system. A module provided with corresponding guide funnels can immediately be attached to the guide pins 74–77 and will thus be secured in the cargo room. For safety reasons, extra, not shown locking devices which prevent the module from jumping off the guide pins can be used if desired.

The cargo-carrying wagon 35 is provided with a respective wheel box 78, 79, 80 and 81 on the cross beam elements 70, 72. In principle, these wheel boxes and the cargo wagon's rails 34 can be assembled in the same way as described previously in connection with the traverse crane. All wheel boxes, or if desired one on each side, are arranged with drivable sets of wheels. Thus, there are shown suitable hydraulic drive motors 82, 83, for the wheel boxes 79 and 80.

Figure 10:
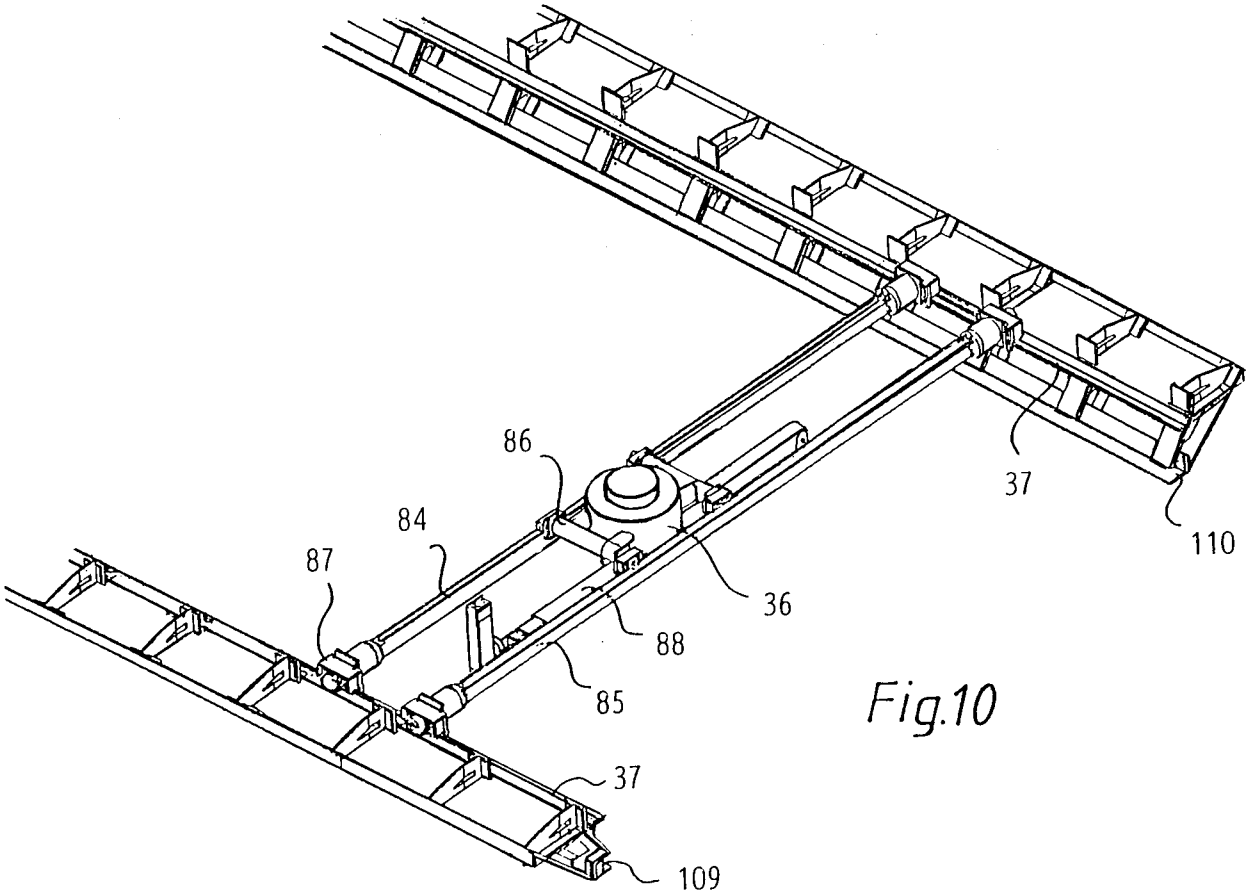
FIG. 10 shows a belly manipulator viewed from above.

The belly manipulator shown in FIG. 10 runs on rails 37, which in principle can be assembled in the same way as the rails 32 for the traverse crane. The belly manipulator 36 consists mainly of two parallel bridge elements 84, 85 on which a drivable wagon 86 can move sideways in the submarine's cargo room. The belly manipulator's cross frame 84, 85 has, in it's ends, respective wheel-boxes 87 with sets of wheels which run on the rails 37. The wheel-boxes and their sets of wheels, as well as any driving motors, can in principle be assembled as described previously in connection with the traverse crane's wheel boxes. The belly manipulator's wagon or trolley 86 is provided in a known way with a manipulator arm 88 which is shown here in a folded-up position. The design of the actual manipulator arm is not really of much interest here, and the belly manipulator can in fact be of any other design, as long as it can perform the intended operations in the underwater production system.

The device for operations can, as mentioned, be used to carry out various work operations. Examples of these will be desribed in more detail as follows.

Figure 15:
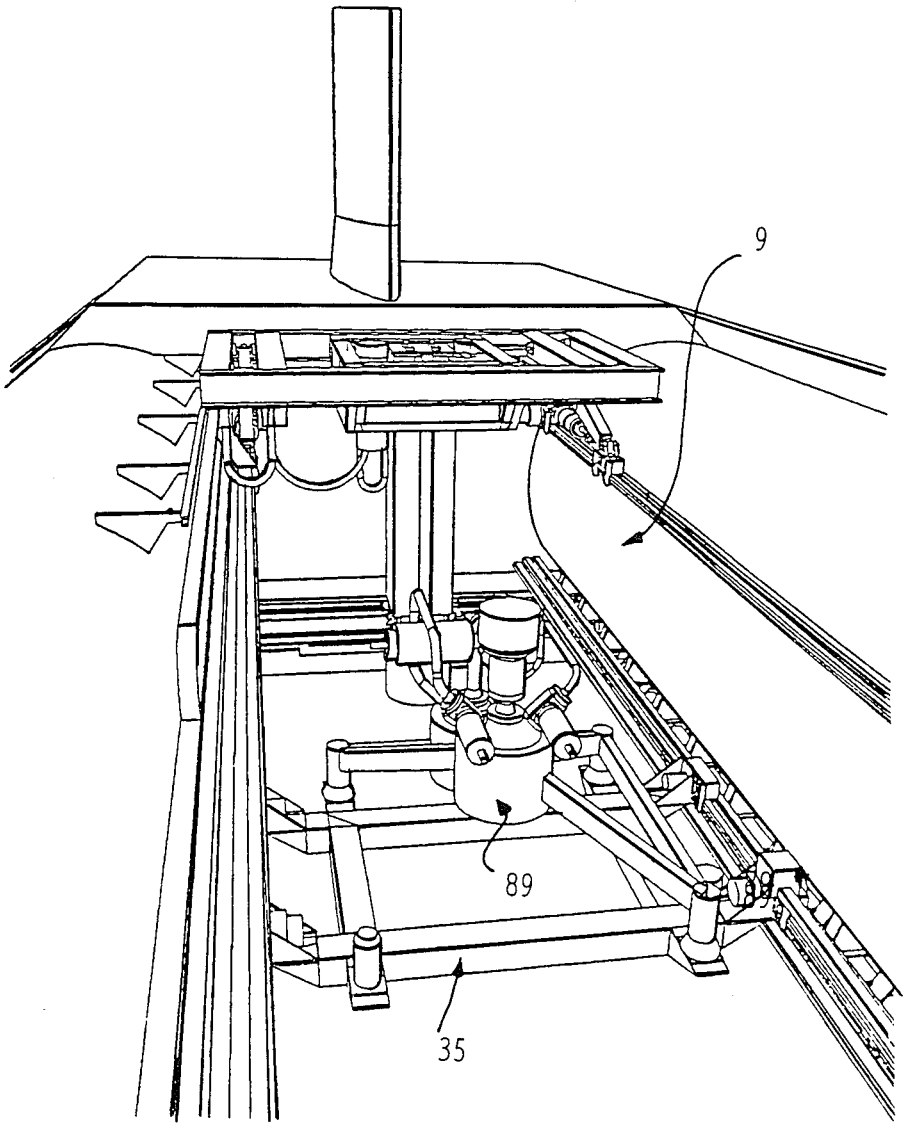
FIG. 15 shows a perspective drawing of the opened cargo hold 9, with a cargo unit placed on the cargo wagon.

An important work operation is the mounting or replacing of modules in the production system. In FIG. 15 there is shown as an example a transition module 89 which is situated on the cargo-carrying wagon 35 in the submarine's cargo room 9. It will be seen that the shown transition module has only three guide funnels, with which it is mounted on to the guide pins on the cargo wagon.

Figure 16:
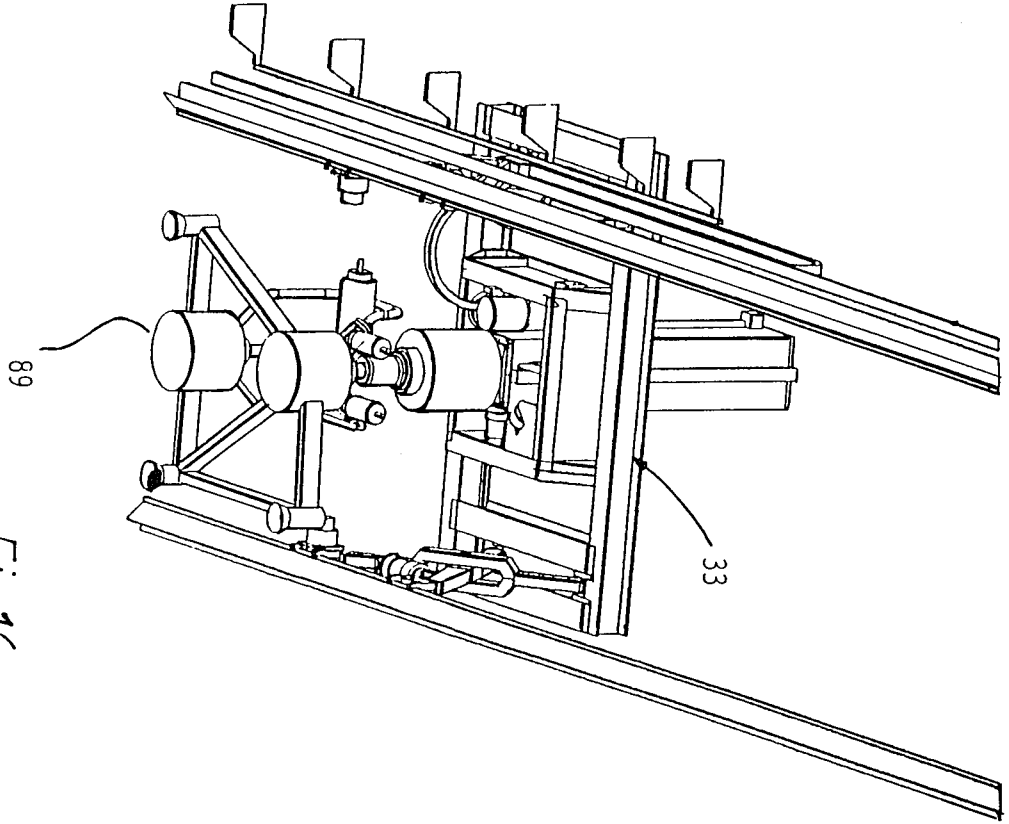
FIG. 16 shows how the cargo unit shown in FIG. 15 is hoisted up bym and is suspended in, the traverse crane.

In FIG. 16 it is shown how the transition module 89 is picked up by, and is suspended in the traverse crane.

Figure 17:
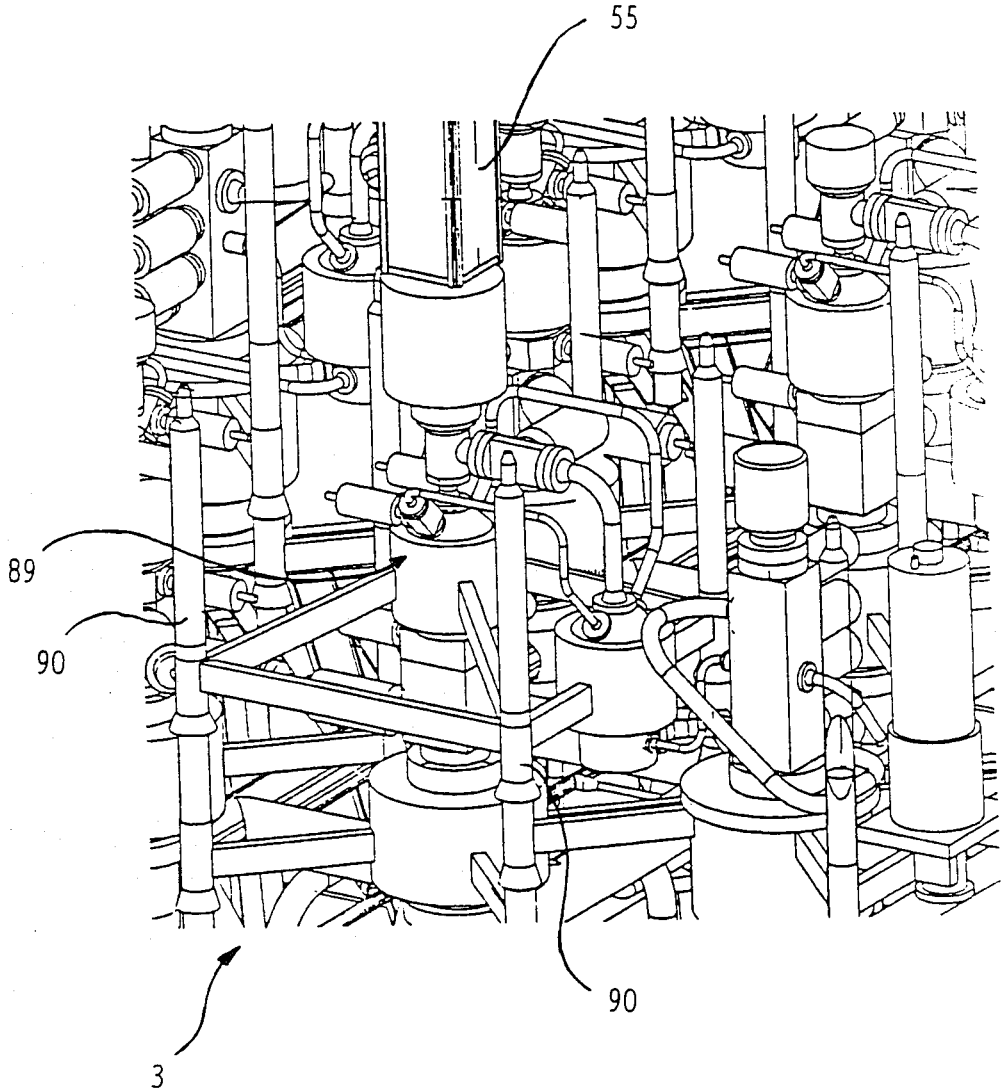
FIG. 17 shows the cargo unit in FIG. 15 and 16 brought into place in the underwater production system.

In FIG. 17 it is shown how the transition module is mounted in the production system, still connected to the traverse crane. In FIG. 17 only the telescopic supportive column 55 can be seen of the traverse crane. In addition, in FIG. 17 some of the surrounding modules are indicated, and the guide posts 90 employed in the underwater production system 3 can be seen clearly.

It is assumed here that the replacement of a transition module 89 is about to take place. Before the replacement operation begins, the crew of the submarine will have ensured that they have control over the well. This can be done in various, known ways. Before the actual replacement operation begins, the following phases of the whole work operation will be completed: The submarine has navigated itselt up to the structure of the underwater production system and has docked. The submarine's crew have taken over control of valves etc. in the underwater production system. The hatches in the cargo hold are naturally open. The traverse crane is raised by means of the shear legs, and the protective roof over the installation has been removed. This protective roof is built up of roof-sections 2, as described previously. These roof-sections 2 can be hoisted up by means of the traverse crane and placed on top of each other, i.e. in a pile at one side. Each such protective roof-section is designed with a central element 91 with which the traverse crane's gripping part can engage.

Figure 18:
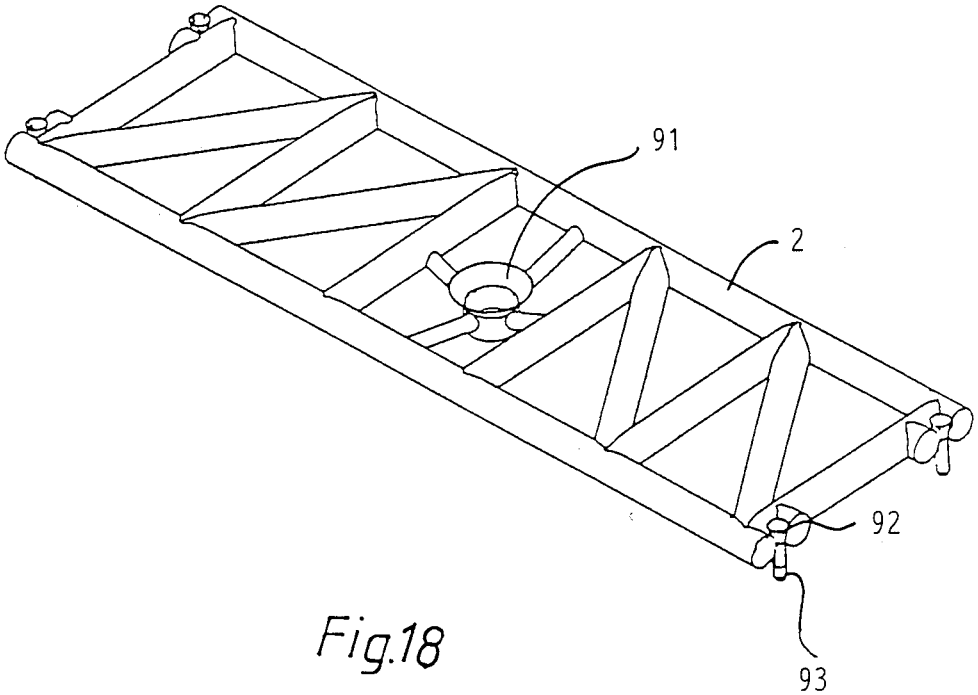
FIG. 18 shows a protective roof which is an integral component in the protective structure.

Such a protective roof section is shown in FIG. 18. It can be seen from this that it is constructed as a framework of pipes welded together, in which the corners are guide funnels 92 combined with guide pins 93.

The transition module to be replaced is uncoupled by means of the belly manipulator. By means of the traverse crane, the transition module is hoisted loose of the coupling flanges and placed either in a special storage place in the underwater system, or in an empty cargon wagon (if the apparatus contains two cargo wagons for this work-operation). Instead of employing the belly manipulator, tools which are coupled to the traverse crane at the land-base can also be used.

The new transition module is collected by the traverse crane, or possibly with another traverse crane (there is nothing to hinder the submarine having two traverse cranes). The new transition module is then positioned and secured. During these work operations, the operator in the submarine is in visual contact, possibly by means of one or more video cameras. After inspection and documentation of the state of the connection this work-operation is complete. During pressure tests etc. of the couplings, the traverse crane can still be connected. It should be mentioned here that the submarine is placed on the protective struture in such a way that it can easily disattach itself from this if it should be necessary for safety reasons.

As soon as the equipment has been tested and uncoupling has taken place, the well can againg be prepared for production. Control of the well can now be transferred from the submarine to the field's control centre.

In principle, the same procedure can be followed in the case of mounting/replacing of other modules which are included in the underwater production system.

Figure 19:
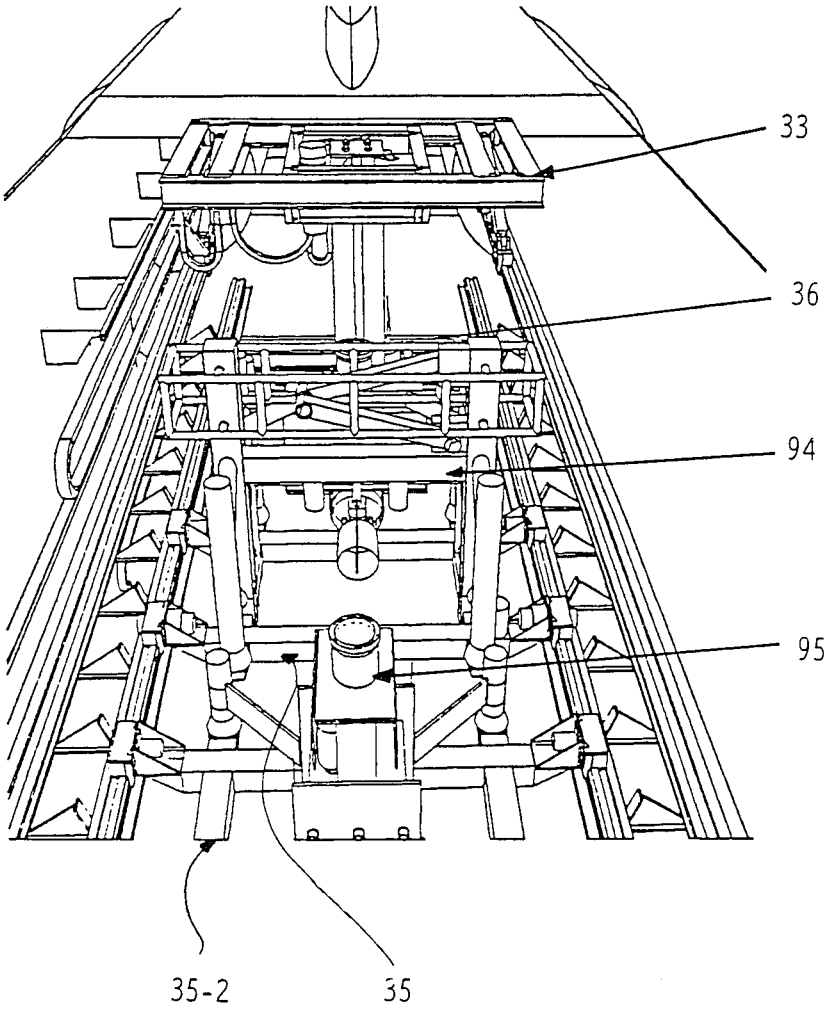
FIG. 19 shows the submarine's cargo hold seen from above, with equipment for pulling-in and connecting of pipelines in the underwater production system, placed therein.

An interesting work operation is the pull-in and connecting of control and export pipelines. FIG. 19 shows the equipment necessary for such an operation, placed in the submarine's cargo room.

In FIG. 19 a pulling-in module 94 is shown mounted on a cargocarrying wagon 35, and another cargo wagon is shown, indicated here by 35-2, which carries a coupling module 95.

Figure 20:
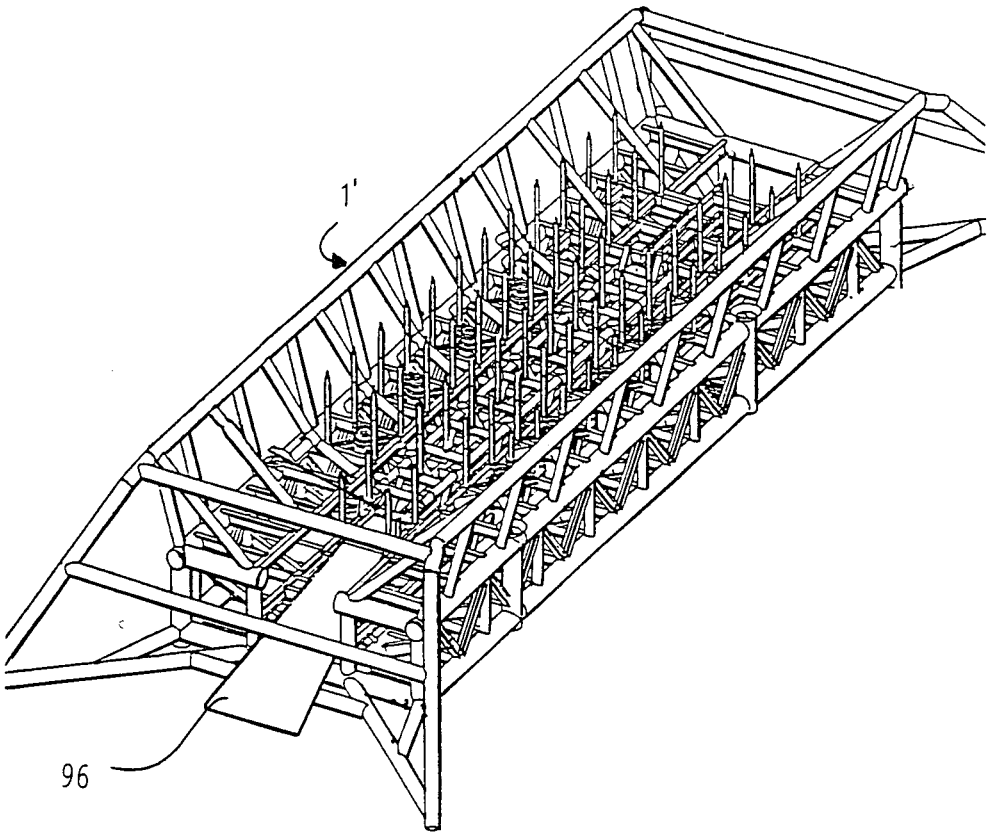
FIG. 20 shows a modified underwater production system with a protective structure.

In FIG. 20 it can be seen how a pull-in site is arranged in the underwater structure, consisting mainly of a ramp 96 which leads up to the site where equipment shown in FIG. 19 is to be placed in the underwater production system, and where the connecting of the pipe-lines will take place.

Figure 21:
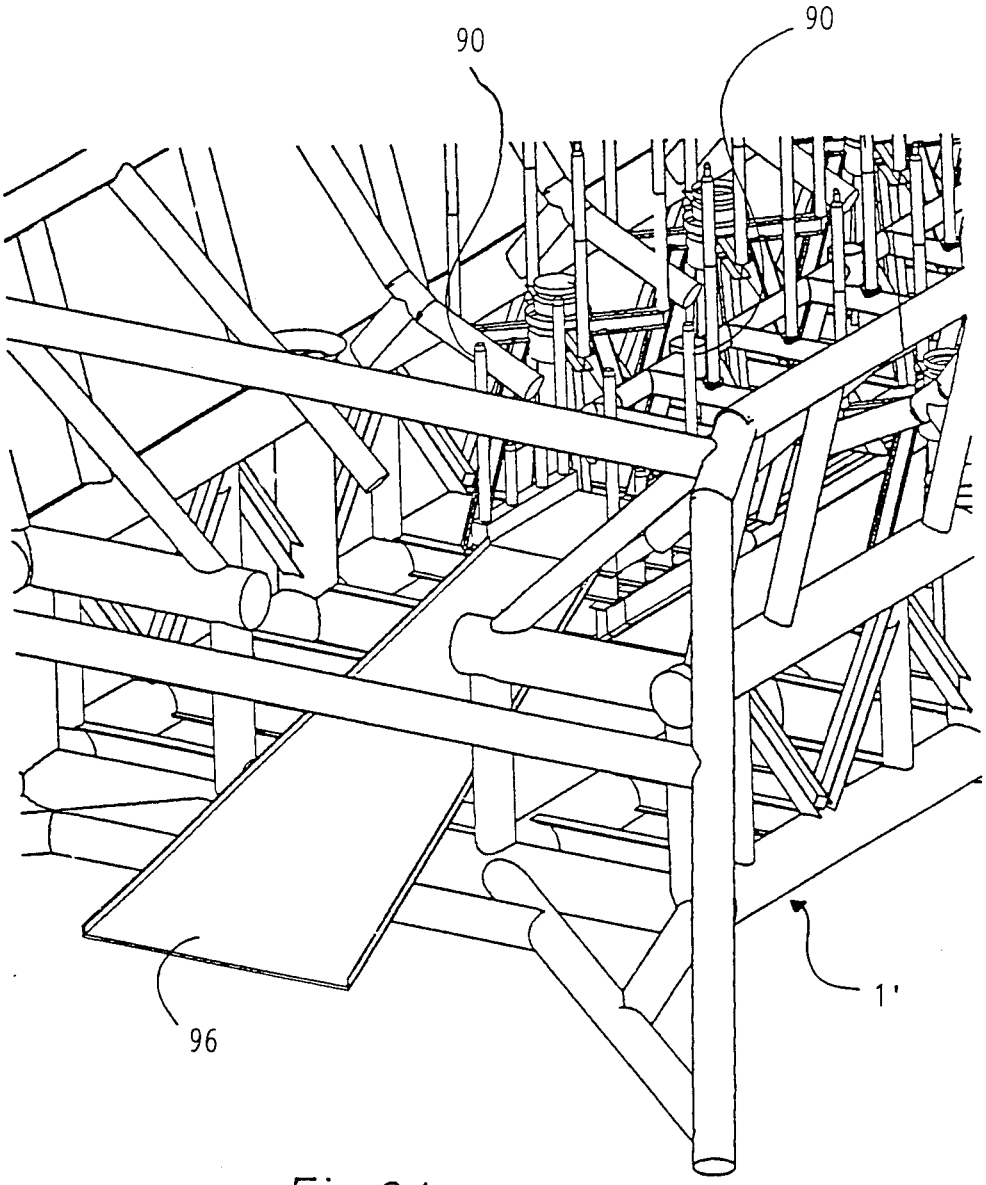
FIG. 21 shows an enlarged section of the installation in FIG. 20.

FIG. 21 shows this position in the underwater structure in a larger scale. The guide posts 90 which are used can also clearly be seen here. The underwater structure shown in FIG. 20 and 21 is in principle built up as the underwater structure 1 in FIG. 1 and 11, but is indicated by the reference numeral 1' in order to distinguish the two structures. However, on studying the structure 1 in FIG. 1 and 11 it will be seen that at the end there is space provided for the ramp 96 shown in FIG. 20 and 21.

Figure 22:
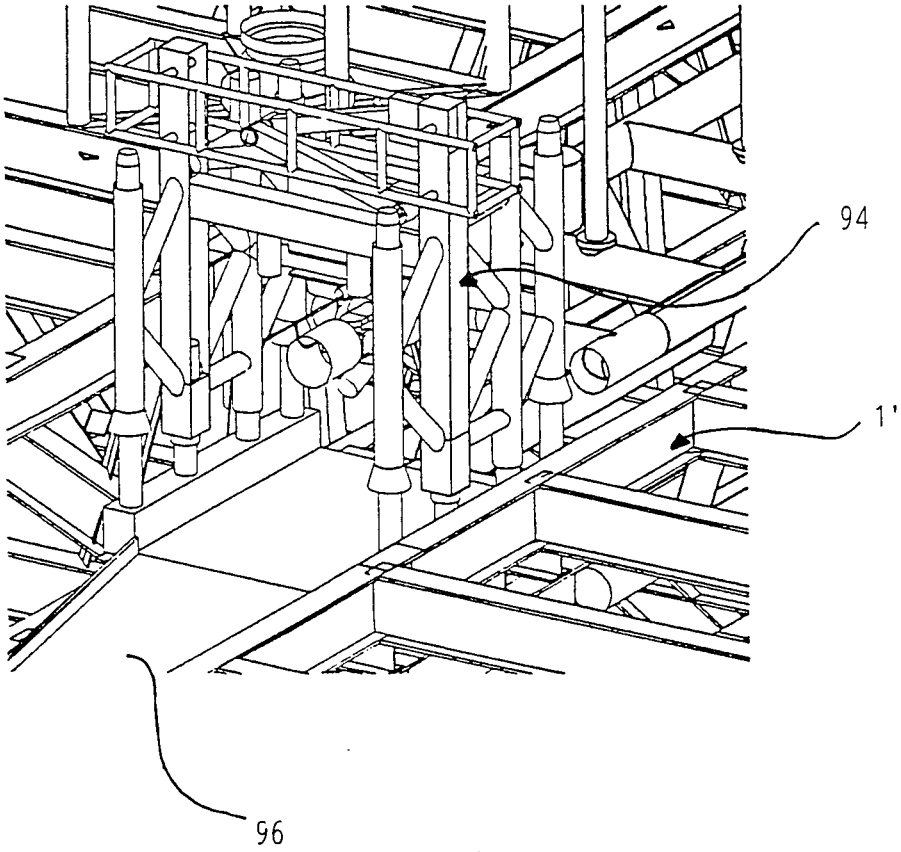
FIG. 22 shows a pull-in module placed in the underwater production system.

In FIG. 22 the necessary pulling-in apparatus, that is the pulling-in module 94 is mounted in the underwater structure 1'. This mounting is carried out by means of the traverse crane 33.

Concerning the assembly of the pulling-in apparatus and the coupling apparatus, that is the modules 94 and 95, reference in this case can be made to US-PS 4.382.717, which illustrates and describes such apparatus, intended for mounting in an underwater production system by means of the initially mentioned guideline technique. That which is described in the presented case is then in reality simply a description of how this known equipment can be used during employment of the work apparatus according to the invention.

Regarding the pull-in of the pipe-lines and their connections, reference can be made to the said U.S. patent for further details.

Figure 23:
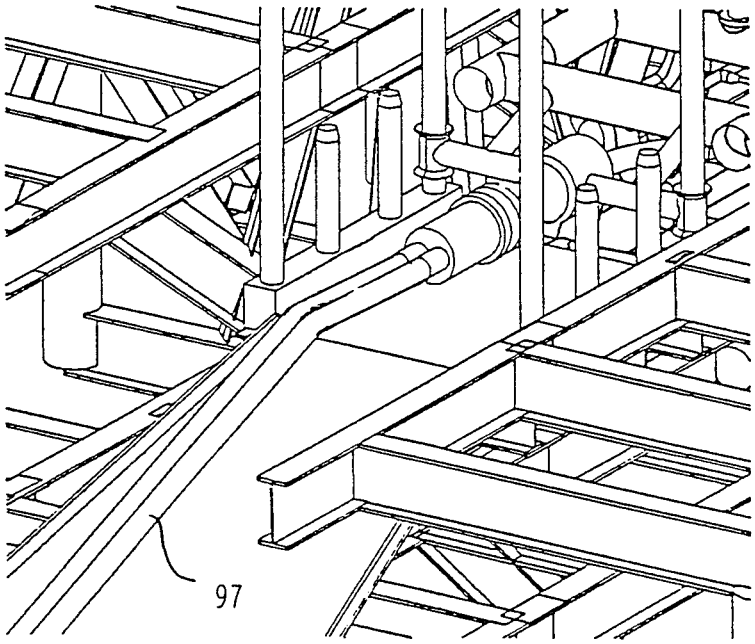
FIG. 23 shows the pulling-in of a pipeline by means of the equipment in FIG. 22.

In FIG. 23 it can be seen how pipe-lines 97 are pulled in by using a known technique. The pipe-lines 97 are shown in FIG. 23 before being coupled. Such coupling takes place by means of the coupling apparatus, that is the coupling module 95, an understanding of which can also be gained from the said U.S. patent.

Figure 24:
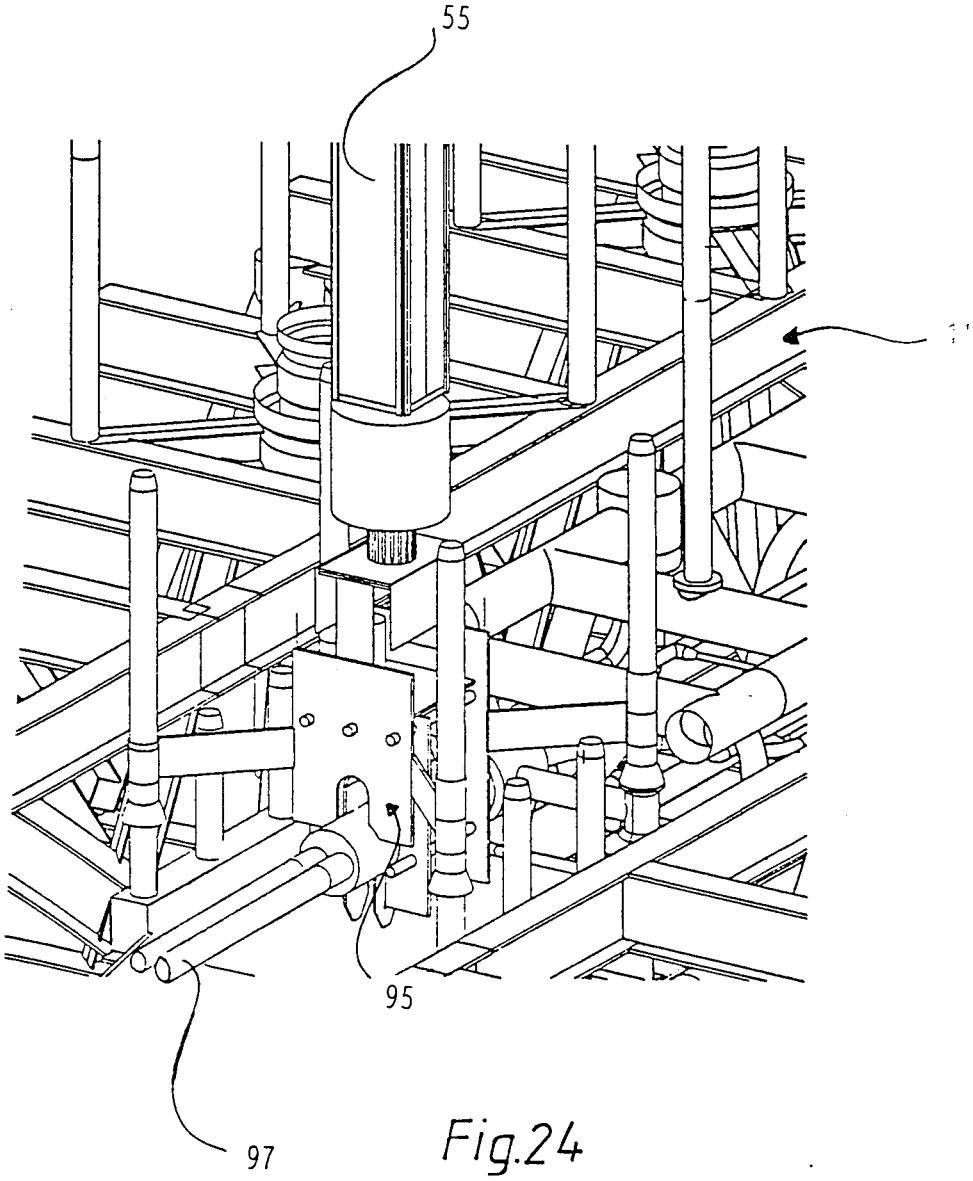
FIG. 24 shows the mounting of a coupling tool in the underwater production system for coupling of pipelines as shown in FIG. 25.

Here it shall just be mentioned that in FIG. 24 it is shown how the coupling module 95 is mounted in the underwater production system, by means of the traverse crane 33, represented by it's supportive column 55 in FIG. 24.

Figure 25:
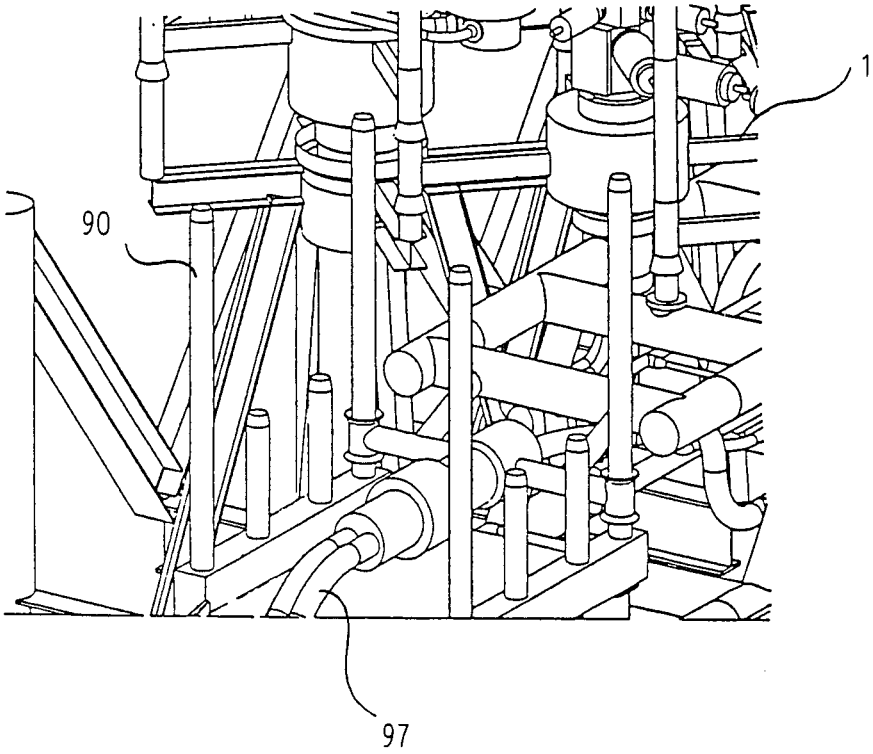

In FIG. 25 the pipeline 97 is shown coupled to the underwater production system. The coupling module is removed by means of the traverse crane, and placed on board in the submarine again. The pulling-in module 94 is naturally also taken on board again before the coupling module was mounted.

As mentioned, other work operations can also be executed, but it is not considered necessary to describe such work operations any further. However, it should be mentioned that for example a so-called pig-module can be introduced into the underwater production system, for pigging of pipe-lines. The underwater production system is then naturally provided with an appropriate site where such a pig-module can be placed by means of the work apparatus according to the invention.

It is mentioned previously that a considerable advantage of the invention is that, with the invention, the possibility is achieved of complete exploitation of the advantages which a submarine concept provides, and at the same time combine this with the known technique. In some cases it will be necessary to make some modifications in the equipment in order to exploit the submarine concept, but in all cases any modifications will be modest and simple. Thus it can be necessary to modify the protective structure on an already existing installation, in order to adjust it for docking of a submarine, and it can also be necessary to make minor modifications to the individual cargo units or modules, but in all cases it is a question of only simple and easy changes which will be obvious for anyone skilled in the art and which will not to any considerable degree reduce the advantages achieved with the new apparatus.

Figure 26:
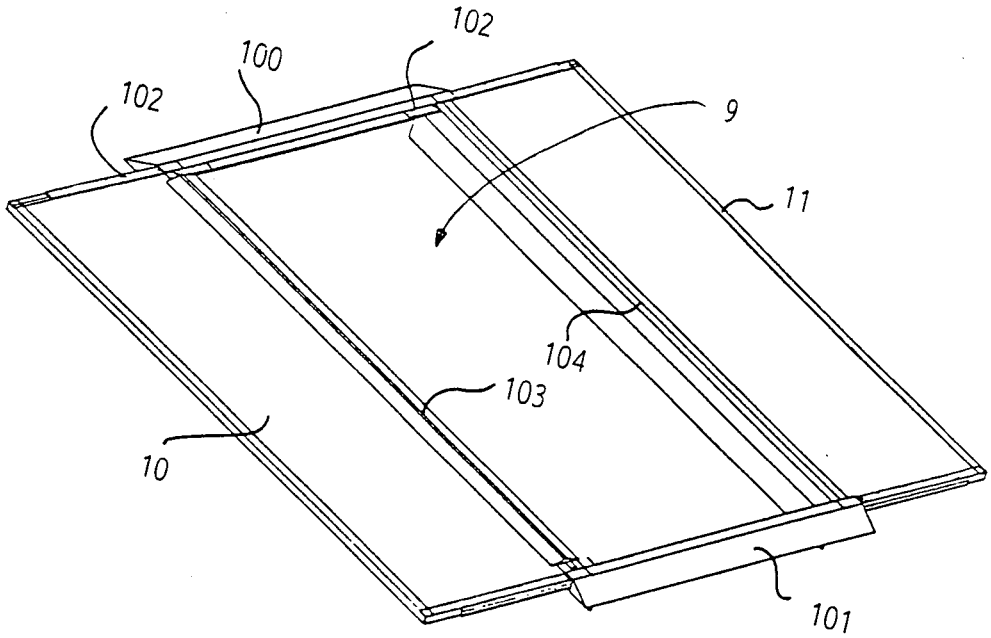
FIG. 26 shows the top hatches only, in an open condition.

As mentioned, the submarine has top hatches and bottom hatches confining the cargo hold 9 up above and down below. In FIG. 26 the top hatches 10, 11 are shown apart, in an opened condition. Reference is also made in this connection to FIG. 1 and 11, where the top hatches 10, 11 are shown in respectively closed and open conditions.

In a preferred embodiment the top hatches are assembled from aluminum elements so that two permanent panels 10 respectively 11 appear which can slide sideways to uncover the cargo hold 9. The panels or hatches 10, 11 slide slideways in frame guiders 100, 101, under intermediary rails 102 with rollers. The hatches are opened/closed by means of not shown hydraulic work cylinders. In order to transfer bending moments the two hatches 10, 11 are provided with a respective lengthwise-running coupling profile 103, 104 which provides form-enclosing joining when the hatches are pushed together. The frame guiders 100, 101 are attached to the submarine's traverse hull, in a manner not shown in further detail, preferably detachably, so that if necessary the entire hatch arm and the hatches can be detached.

Figure 27:
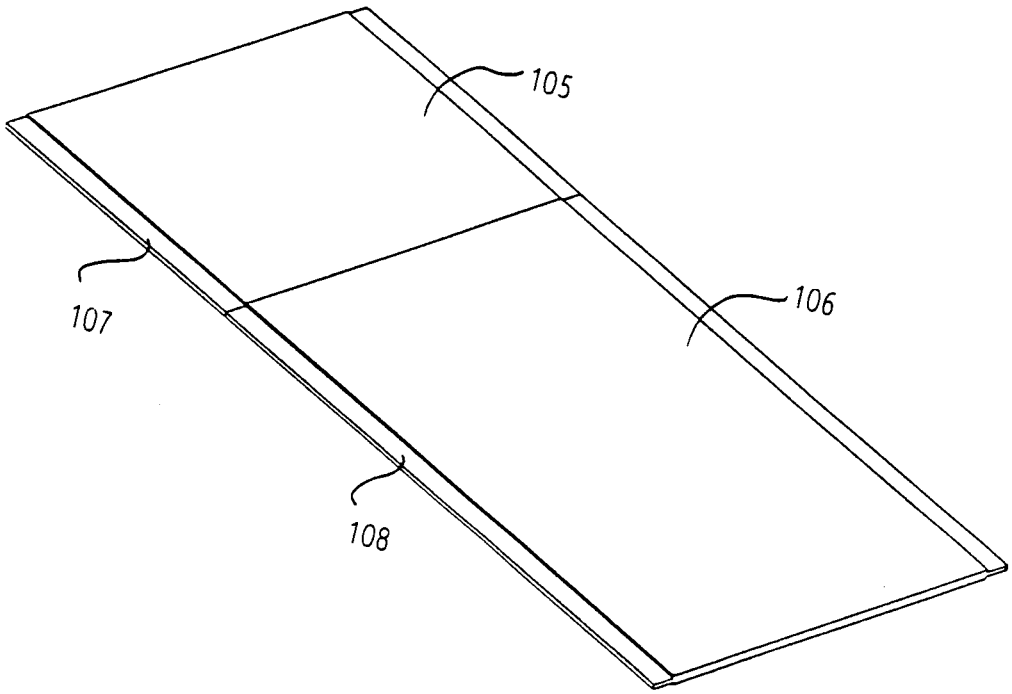
FIG. 27 shows the bottom hatches only, in a closed condition.

In FIG. 27 the bottom hatches 105, 106 are shown. The division here is across the submarine's or cargo hold's longitudinal direction. The figure only shows the actual hatches. Their longitudinal edges 107, 108 are intended for engagement with and guidance by tracks 109 and 110 which are arranged in the rail structure which forms the rails 37 for the belly manipulator, see FIG. 10. The bottom hatches open and close in an appropriate manner, for example by means of driven winches.

I claim:

1. A twin-hull autonomous submarine for docking and moving about a protective structure of the type that protects underwater production systems, said submarine having two pressure hulls, said two pressure hulls defining a cargo hold therebetween, said cargo hold limited externally by a top hatch and a bottom hatch, said top hatch and bottom hatch movably affixed to said pressure hulls, said submarine comprising:

(a) at least three pair of longitudinal rails, each pair of rails of said three pair of rails positioned at different levels between said pressure hulls, one rail of each pair of said three pair of rails affixed to one of said two pressure hulls and the other rail of said pair of said three pairs of rails affixed to the other of said two pressure hulls;

(b) at least one tranverse crane, movably positioned on a first pair of rails of said three pair of longitudinal rails, said transverse crane having raising means for raising and lowering said transverse crane with respect to said one pair of rails;

(c) at least one cargo wagon, movably positioned on a second pair of rails of said three pair of longitudinal rails;

(d) a belly manipulator, movably positioned on a third pair of rails of said three pair of longitudinal rails; and (e) docking and moving means for docking and moving said submarine on said protective structure, said docking and moving means affixed to said pressure hulls.

2. The submarine of claim 1 wherein said raising means is a pair of shear-legs, each one of said pair of shear-legs affixed at one end to said transverse crane and at the other end affixed to a wheel box, said wheel box for moving said transverse crane on said first pair of rails.

3. The submarine of claim 1 wherein a trolley is movably mounted on said transverse crane, said trolley having a vertical, raisable and lowerable telescoping lifting yoke.

4. The submarine of claim 1 wherein the cargo wagon is a rectangular frame having a guide pin positioned at each corner of said rectangular frame and a pair of wheel boxes on two sides of said frame, said two sides being opposite sides of said frame.

5. The submarine of claim 1 wherein both the bottom hatch and top hatch are horizontal pushable hatches.

6. The submarine of claim 5 wherein the bottom hatch is divided crosswise with respect to the twin hulls and said bottom hatch is opened by pushing on said hatch in a longitudinal direction with respect to the twin hulls.

7. The submarine of claim 5 wherein the top hatch is divided along a center line with respect to said twin hulls and said top hatch is opened by pushing athwart said center line.

8. The submarine of claim 1 wherein the docking and moving means comprises at least two pair of wheel boxes, one pair of said two pair of wheel boxes affixed to one hull of said two pressure hulls and the other pair of said two pair of wheel boxes affixed to the other of said two pressure hulls.

9. The submarine of claim 8 further comprising at least four vertical, extractable and rectractable guide elements, one of each of said four guide elements affixed to said pressure hulls near each of said wheel boxes, said guide elements for engagement with a corresponding element on said protective structure.

10. The submarine of claim 1 wherein said docking and moving means comprises at least four sets of rollers, each set of rollers comprising two horizontal rollers and one vertical roller, said horizontal and vertical rollers able to engage an upper frame element of said protective structure.

* * * * *